US006142081A

United States Patent [19]

Long et al.

[11] Patent Number: 6,142,081

[45] Date of Patent: Nov. 7, 2000

[54] PEDESTAL ROCKER SEAT FOR PROVIDING PASSIVE AXLE STEERING TO A RIGID RAILWAY TRUCK

[75] Inventors: Jack R. Long, St. Charles, Ill.; Hans B. Weber, Rotonda West, Fla.

[73] Assignee: Naco, Inc., Downers Grove, Ill.

[21] Appl. No.: 09/074,718

[22] Filed: May 7, 1998

[51] Int. Cl.[7] ..... B61F 15/00

[52] U.S. Cl. ..... 105/218.1; 105/206.1; 105/218.2

[58] Field of Search ..... 105/206.1, 218.1, 105/218.2, 219, 220, 223, 225

[56] References Cited

U.S. PATENT DOCUMENTS

| | | |
|---|---|---|
| 2,668,505 | 2/1954 | Janeway . |
| 3,274,955 | 9/1966 | Thomas . |
| 3,381,629 | 5/1968 | Jones . |
| 3,461,814 | 8/1969 | Weber et al. . |
| 3,670,660 | 6/1972 | Weber et al. . |
| 3,699,897 | 10/1972 | Sherrick . |
| 3,785,298 | 1/1974 | Reynolds . |
| 3,965,825 | 6/1976 | Sherrick . |
| 4,363,278 | 12/1982 | Mulcahy . |
| 4,413,569 | 11/1983 | Mulcahy . |
| 4,455,946 | 6/1984 | List . |
| 4,458,604 | 7/1984 | Cope . |
| 4,674,412 | 6/1987 | Mulcahy et al. . |
| 5,027,716 | 7/1991 | Weber et al. . |
| 5,081,935 | 1/1992 | Pavick ..... 105/218.1 |
| 5,237,933 | 8/1993 | Bucksbee . |
| 5,404,826 | 4/1995 | Rudibaugh et al. . |
| 5,463,964 | 11/1995 | Long et al. . |
| 5,503,084 | 4/1996 | Goding et al. . |
| 5,537,932 | 7/1996 | Jones . |

OTHER PUBLICATIONS

National Castings Swing Motion Truck Catalog, Apr. 1988.

*Primary Examiner*—S. Joseph Morano
*Assistant Examiner*—Robert J. McCarry, Jr.
*Attorney, Agent, or Firm*—Lee, Mann, Smith McWilliams, Sweeney & Ohlson

[57] ABSTRACT

A pedestal rocker seat arrangement adapted for use in connection with the side frame of a railway truck and with a roller bearing adapter member. The pedestal rocker seat includes an elastomeric pad adapted to be placed within the pedestal roof cavity of the pedestal of a side frame. The pad includes a base member adapted to engage the pedestal and a generally pyramidal-shaped projection extending downwardly from the base member. The pedestal rocker seat also includes a rocker member having a top side including a generally pyramidal-shaped cavity adapted to matingly receive the pyramidal-shaped projection of the elastomeric pad. The rocker member also includes a convex generally cylindrical-shaped curved rocker surface that is adapted to contact the roller bearing adapter member. The pedestal rocker seat provides resistance to hunting and passive axle steering for improved curving.

17 Claims, 8 Drawing Sheets

PEDESTAL ROCKER SEAT FOR PROVIDING PASSIVE AXLE STEERING TO A RIGID RAILWAY TRUCK

BACKGROUND OF THE INVENTION

The present invention is directed to a pedestal rocker seat for coupling a roller bearing adapter and associated rotatable axle to the pedestal of a side frame of a railway car truck, and in particular to a pedestal rocker seat arrangement or assembly that allows transverse rocking movement of the side frame with respect to the axle and that provides passive axle steering.

Rigid railway trucks, such as the SWING MOTION truck manufactured by National Castings Inc., a wholly-owned subsidiary of NACO, Inc., as disclosed in U.S. Pat. Nos. 3,461,814, 3,670,660 and 5,463,964, include two spaced apart parallel side frames and an interconnecting bolster. The truck is made rigid by means of a transom or tubular structure connecting the two side frames together at the height of the side frame spring seats. Such H-frame rigid truck types are used under passenger and freight cars in high speed service and offer improved axle alignment, improved tracking, and increased interaxle shear stiffness over what is provided by non-rigid trucks. However, when a rigid truck negotiates a curve practically all of the guiding force between the rail and the flanges of the wheels on the truck is produced between the leading outer wheel of the leading axle of the truck, while the trailing axle is disposed nearly parallel to a radius of the curve such that the trailing outer wheel of the trailing axle has no predominant flange contact with the rail and thereby no flange force of any appreciable magnitude is generated between the rail and the flange of the outer trailing wheel. Conversely, non-rigid trucks permit part of the guiding force during curving to be taken by the outer trailing wheel of the trailing axle, therefore reducing somewhat the force applied to the flange ofthe leading outer wheel.

Flange force, the force applied between the flange of a wheel and the rail, is one of the important factors in evaluating wheel and rail wear, fuel efficiency, safety and performance of a truck. Many railroad technicians do not look beyond the leading outer wheel of a truck when evaluating a truck's performance. Rigid trucks have therefore often acquired undeserved poor evaluations in spite of good service records. The present invention incorporates passive axle steering in rigid trucks, such as the SWING MOTION trucks manufactured by National Castings, which results in a reduction of the angle of attack between the wheel and the rail during curving, the second most important factor for evaluation of curving performance of a truck, thereby decreasing the flange force on the leading outer wheel, while allowing transverse rocking of the side frame with respect to the axle to control hunting, thereby improving the truck's performance.

SUMMARY OF THE INVENTION

A pedestal rocker seat adapted for use in connection with a railway car truck. The railway truck includes a pair of spaced apart generally parallel side frames with each side frame having a pedestal at each end. Each pedestal includes spaced apart first and second pedestal jaws and a pedestal roof including a pedestal roof cavity. A roller bearing adapter member is located between the first and second pedestal jaws and is adapted to receive an axle assembly including a bearing and an axle having a pair of wheels.

The pedestal rocker seat includes an elastomeric pad adapted to be placed within the pedestal roof cavity of the pedestal of the side frame. The pad includes a base member having an upper surface adapted to be placed in engagement with the pedestal of the side frame and a generally pyramidal-shaped projection extending outwardly and downwardly from the base member. The projection includes a generally pyramidal-shaped lower surface. The upper surface and the lower surface of the pad are disposed on opposites of the pad relative to one another. The pedestal rocker seat also includes a rocker member having a top side and an opposing bottom side. The top side includes a generally pyramidal-shaped surface forming a generally pyramidalshaped cavity. The projection of the elastomeric pad is adapted to be disposed in the pyramidalshaped cavity ofthe rocker member. The pyramidal-shaped cavity is complementarily shaped with respect to the pyramidal-shaped projection such that the pyramidal-shaped surface of the projection matingly engages the pyramidal-shaped surface of the cavity of the rocker member. The bottom side of the rocker member includes a convex generally cylindrical-shaped curved rocker surface. The rocker surface is curved about a generally linear axis. The rocker surface is adapted to rockably engage the roller bearing adapter member with the linear axis of the rocker member disposed generally parallel to the longitudinal axis of the side frame.

The elastomeric pad and the rocker surface of the rocker member enable the side frame to transversely rock with respect to the axle. The pyramidal-shaped projection of the elastomeric pad enables the axle to pivot horizontally with respect to the side frame to provide the truck with passive axle steering.

BRIEF DESCRIPTION OF THE DRAWING FIGURES

DETAILED DESCRIPTION OF THE PREFERRED EMBODIMENTS

Figure 1:
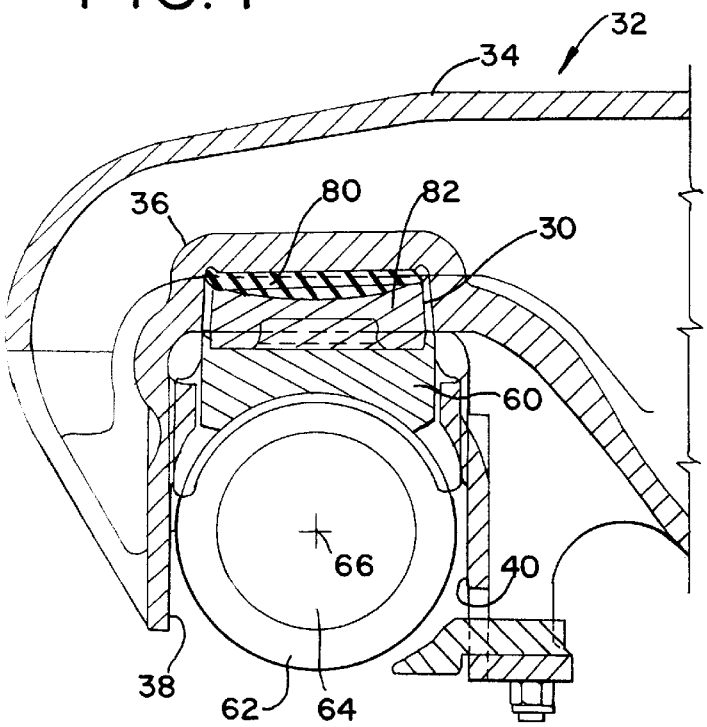
FIG. 1 is a longitudinal cross-sectional view of the pedestal rocker seat of the present invention shown installed in the pedestal of a railway truck side frame and coupled to a roller bearing adapter and axle assembly.
Figure 2:
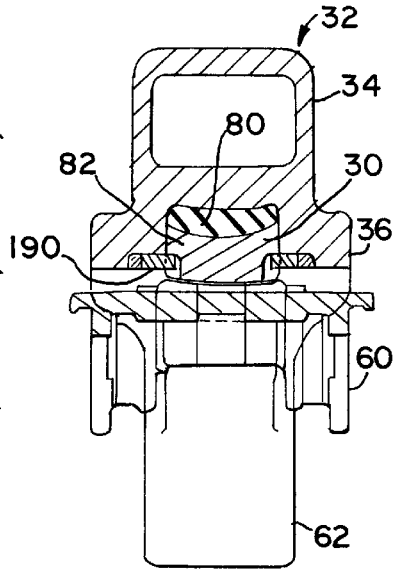
FIG. 2 is a transverse cross-sectional view of the pedestal rocker seat shown in its installed position.
Figure 3:
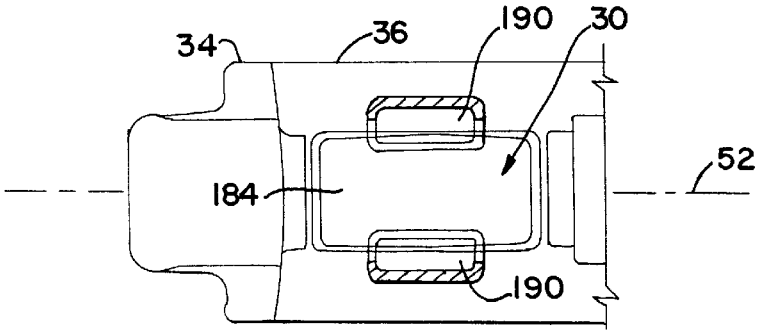
FIG. 3 is a bottom view of the pedestal rocker seat shown in its installed position
Figure 4:
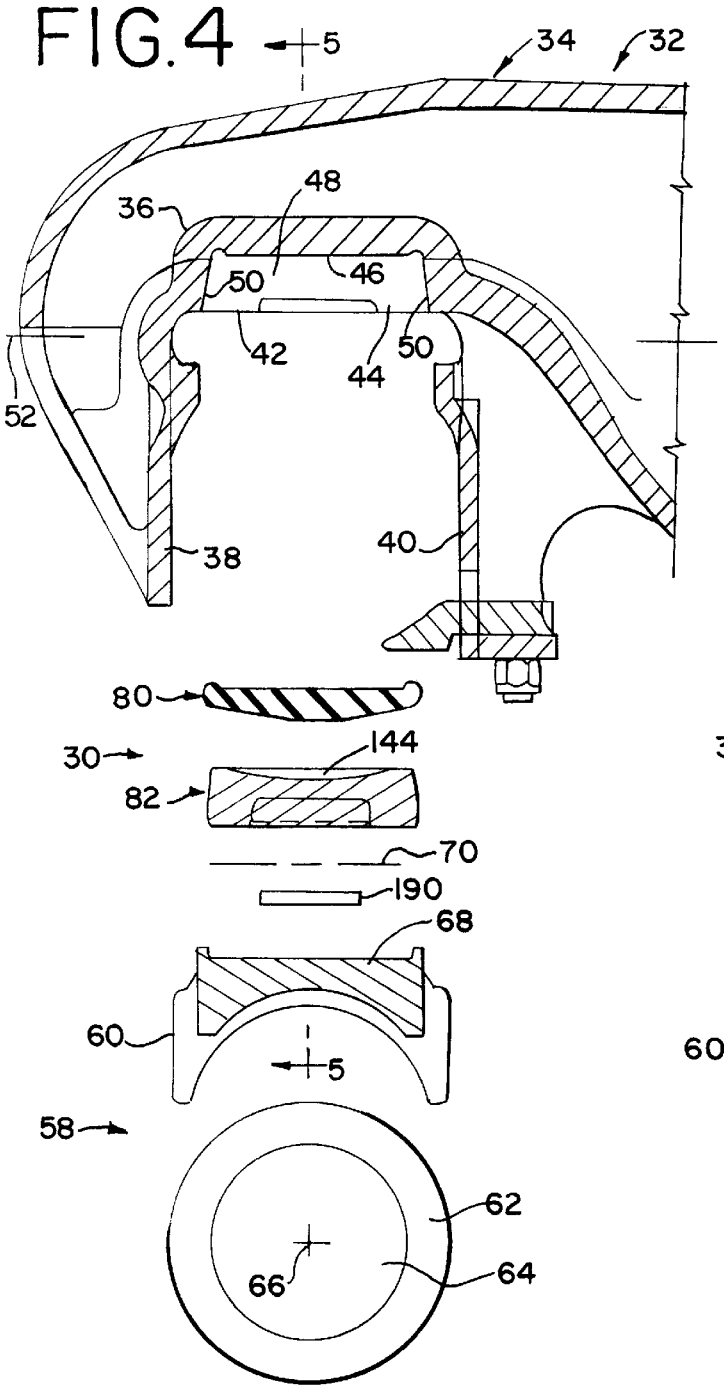
FIG. 4 is a longitudinal cross-sectional exploded view of the pedestal rocker seat, side frame, roller bearing adapter and axle assembly.
Figure 5:
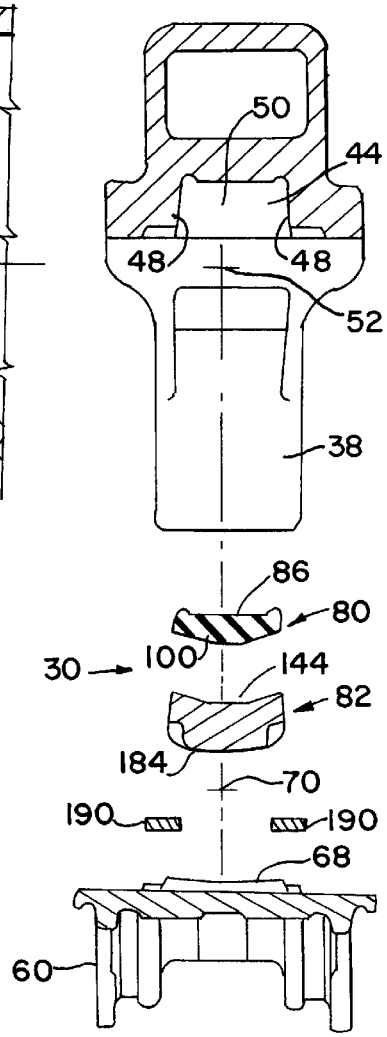
FIG. 5 is a transverse cross-sectional exploded view taken along line 5—5 of FIG. 4.

The pedestal rocker seat assembly 30 of the present invention is shown in FIGS. 1–3 installed in a railway truck 32. The railway truck 32 is a generally H-shaped rigid truck such as disclosed in U.S. Pat. Nos. 3,461,814, 3,670,660 and 5,463,964, which are incorporated herein by reference. The truck 32 includes a pair of spaced apart and generally parallel side frames 34 (only one shown). The side frames 34 are connected to one another by a bolster and a transom or tubular structure (not shown). Each side frame 34 includes a pedestal 36 at each end. The pedestal 36 includes a first generally vertical pedestal jaw 38 and a spaced apart second generally vertical pedestal jaw 40, and a pedestal roof 42. The pedestal roof 42 includes a pedestal roof cavity 44. The pedestal roof cavity 44 is formed by a top wall 46, a pair of spaced apart longitudinal side walls 48, and a pair of spaced apart transverse side walls 50. The side frame 34 includes a longitudinal axis 52.

The railway truck 32 includes a roller bearing adapter and axle assembly 58 that is adapted to be disposed between the first and second pedestal jaws 38 and 40 in each pedestal 36. The roller bearing adapter and axle assembly 58 includes a roller bearing adapter 60, a bearing 62 and an axle 64 having a pair of flanged wheels (not shown) and a central longitudinal axis 66 that is disposed generally perpendicular to the longitudinal axis 52 of the side frame 34. The roller bearing adapter 60 is preferably a reverse crown adapter as manufactured by National Castings Inc. The upper side of the roller bearing adapter 60 includes a concave generally cylindrically-shaped curved surface 68 formed at a first radius from a linear axis 70 that extends generally parallel to the longitudinal axis 52 of the side frame 34. The bottom side of the roller bearing adapter 60 is adapted to receive the bearing 62 and the axle 64 such that the axle 64 is coupled to the roller bearing adapter 60 for rotation about the longitudinal axis 66.

Figure 6:
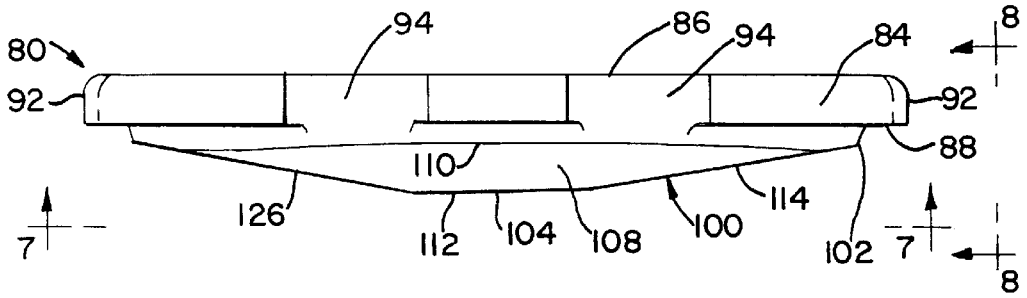
FIG. 6 is a side elevational view of the elastomeric pad of the pedestal rocker seat.
Figure 7:
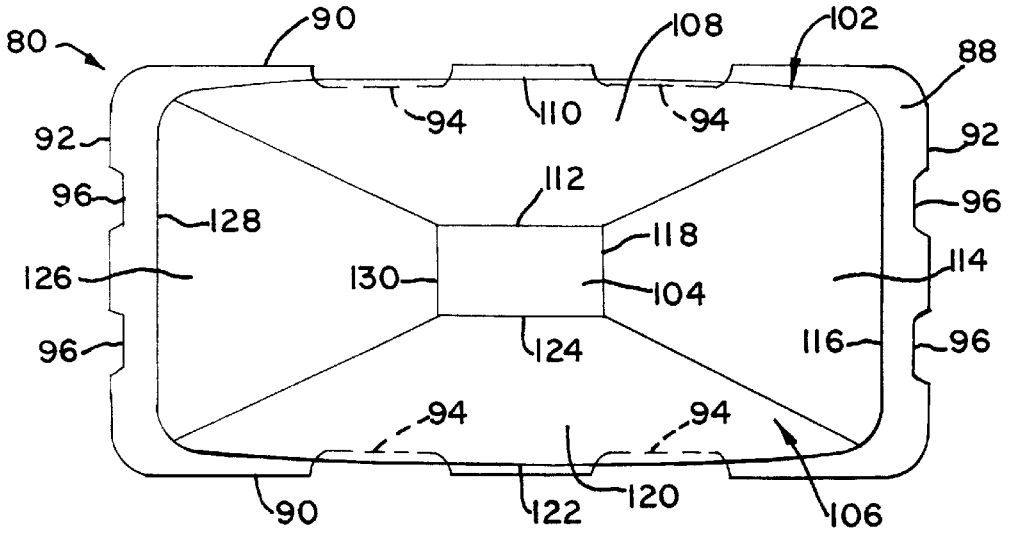
FIG. 7 is a bottom view of the elastomeric pad taken along line 7—7 of FIG. 6.
Figure 8:
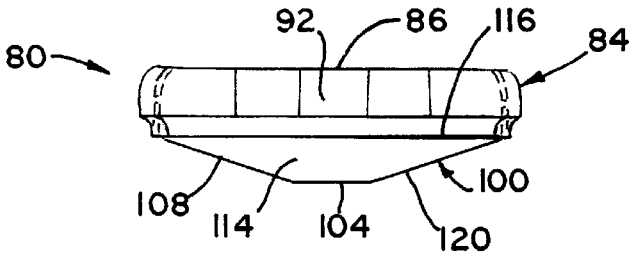
FIG. 8 is an end view of the elastomeric pad taken along line 8—8 of FIG. 6.

The pedestal rocker seat 30 includes an elastomeric pad 80 and a rocker member 82. As best shown in FIGS. 6–8, the elastomeric pad 80 includes a generally rectangular elastomeric base member 84. The base member 84 includes a generally planar upper surface 86 and an opposing lower surface 88. The bas e member 84 also includes a p air of opposing and generally parallel longitudinal side walls 90 and a pair of opposing and generally parallel transverse side walls 92. Each ofthe longitudinal side walls 90 includes a pair of spaced apart grooves 94. Each of the transverse side walls 92 includes a pair of spaced apart grooves 96.

The elastomeric pad 80 also includes an elastomeric generally pyramidal-shaped projection 100 that extends outwardly and downwardly from the lower surface 88 of the base member 84. The projection 100 includes a generally rectangular base 102 located adjacent to the lower surface 88 having four generally linear edges. The projection 100 is a right rectangular pyramid that is preferably formed as a pyramidal frustum having a truncated apex. The projection 100 includes a generally planar apex surface 104 at the apex of the projection 100. A generally pyramidalshaped surface 106 extends from the base 102 to the apex of the projection 100. The pyramidalshaped surface 106 includes a generally planar and generally triangular-shaped first face 108 having a base 110 adjacent the lower surface 88 and a truncated tip 112 adjoining the apex surface 104, and a generally planar and generally triangular-shaped second face 114 having a base 116 adjacent the lower surface 88 and a truncated tip 118 adjoining the apex surface 104. The surface 106 also includes a generally planar and generally triangular-shaped third face 120 having a base 122 adjacent the lower surface 88 and a truncated tip 124 that adjoins the apex surface 104. The surface 106 also includes a generally planar and generally triangular-shaped fourth face 126 having a base 128 adjacent the lower surface 88 and a truncated tip 130 adjoining the apex surface 104.

The base 110 and the base 122 of the first and third faces 108 and 120 are spaced apart and generally parallel to one another. The base 116 and the base 128 of the second and fourth faces 114 and 126 are spaced apart and generally parallel to one another and generally perpendicular to the base 110 and base 122. The base 110 and the base 122 are approximately the same length. The base 116 and the base 128 are approximately the same length, but are both shorter than the base 110 and the base 122. Each ofthe faces 108, 114, 120 and 126 is generally formed as a truncated isosceles triangle such that each side of the triangle forms an approximately equal angle with the base of the triangle and each of the faces is inclined with respect to the lower surface 88 and the upper surface 86. The apex surface 104 of the projection 100 is generally centered with respect to the rectangular base 102 as shown in FIG. 7. The apex surface 104 is generally parallel to the upper surface 86 and lower surface 88 of the base member 84.

The elastomeric pad 80 is sized to fit within the pedestal roof cavity 44 of the side frame 34 such that the upper surface 86 of the base member 84 engages the top wall 46 of the pedestal 36. The side walls 90 and 92 of the base member 84 are adapted to fit closely within the side walls 48 and 50 of the pedestal roof cavity 44. The elastomeric pad 80 is preferably formed from an elastomeric material such as a natural and synthetic rubber compound having a sheer stiffness of 22,000 to 35,000 pounds per inch.

Figure 9:
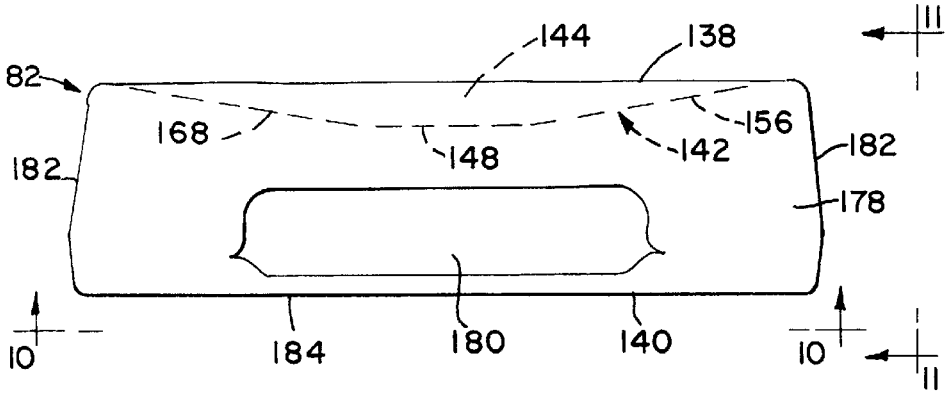
FIG. 9 is a side elevational view of the rocker member of the pedestal rocker seat.
Figure 10:
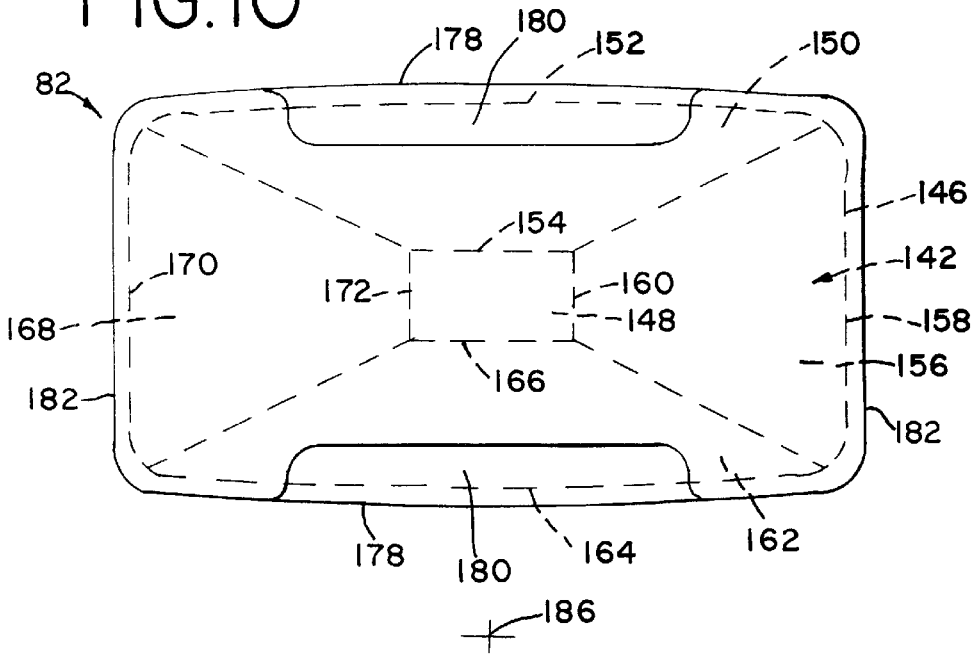
FIG. 10 is a bottom view of the rocker member taken along line 10—10 of FIG. 9.
Figure 11:
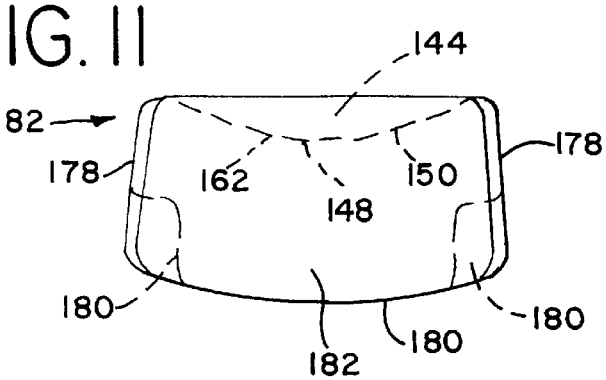
FIG. 11 is an end view of the rocker member taken along line 11—11 of FIG. 9.
Figure 12:
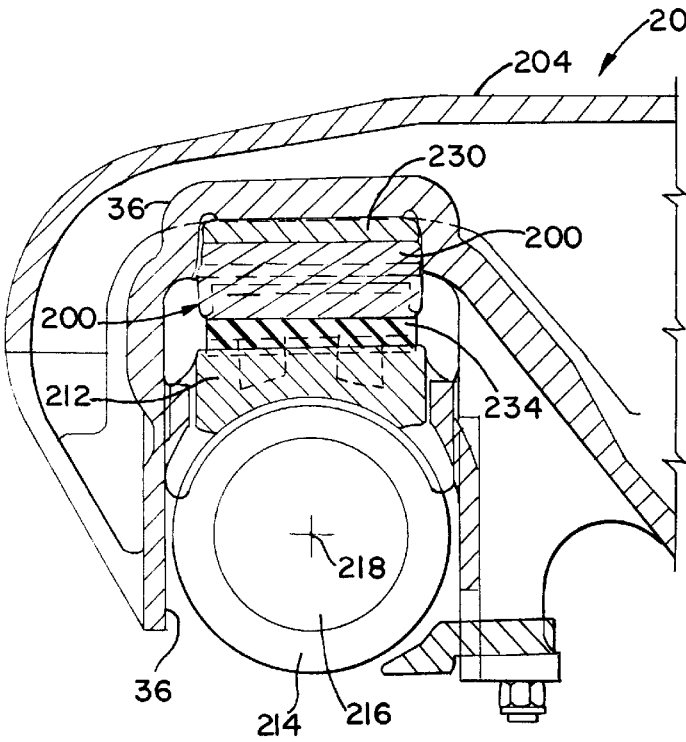
FIG. 12 is a longitudinal cross-sectional view of a modified embodiment of the pedestal rocker seat shown installed in the pedestal of a railway truck side frame and coupled to a roller bearing adapter and axle assembly.

The rocker member 82 as best shown in FIGS. 9–11 includes a top side 138 and an opposing bottom side 140. The top side 138 includes a generally pyramidal-shaped surface 142 that forms a generally pyramidal-shaped cavity 144. The pyramidal-shaped surface 142 and cavity 144 are complementarily shaped with respect to the pyramidal-shaped surface 106 of the projection 100 such that the pyramidal-shaped surface 106 of the projection 100 will matingly engage the pyramidal-shaped surface 142 of the cavity 144. The pyramidal-shaped surface 142 includes a generally rectangular base 146. The pyramidal-shaped cavity 144 generally conforms to the shape of a right rectangular pyramidal-frustum having a truncated apex. The apex of the pyramidal-shaped cavity 144 includes a generally planar apex surface 148 that is adapted to matingly engage the apex surface 104 of the projection 100. The pyramidal-shaped surface 142 includes a generally planar and generally triangular-shaped first face 150 having a base 152 and a truncated tip 154 adjoining the apex surface 148. The pyramidal-shaped surface 142 includes a generally planar and generally triangular-shaped second face 156 having a base 158 and a truncated tip 160 adjoining the apex surface 148. The surface 142 also includes a generally planar and generally triangular-shaped third face 162 having a base 164 and a truncated tip 166 adjoining the apex surface 148. The surface 142 also includes a generally planar and generally triangular-shaped fourth face 168 having a base 170 and a truncated tip 172 adjoining the apex surface 148.

The first face 150 of the cavity 144 is complementarily shaped with respect to, and is adapted to matingly engage, the first face 108 of the projection 100. The second face 156 of the cavity 144 is complementarily shaped with respect to, and is adapted to matingly engage, the second face 114 of the projection 100. The third face 162 of the cavity 144 is complementarily shaped with respect to, and is adapted to matingly engage, the third face 120 of the projection 100. The fourth face 168 of the cavity 144 is complementarily shaped with respect to, and is adapted to matingly engage, the fourth face 126 of the projection 100. The projection 100 is adapted to be inserted into the cavity 144 such that the projection 100 substantially fills the cavity 144.

The rocker member 82 includes a pair of spaced apart longitudinal side walls 178. Each longitudinal side wall 178 includes a longitudinally extending groove 180. The rocker member 82 also includes a pair of spaced apart transverse side walls 182. The transverse side walls 182 are generally parallel to one another and perpendicular to the longitudinal side walls 178 such that the rocker member 82 is generally rectangular as shown in FIG. 10.

The bottom side 140 of the rocker member 82 includes a convex generally cylindrical-shaped curved rocker surface 184 that is formed at a second radius about a linear axis 186. The second radius that forms the curved rocker surface 184 is shorter than the first radius that forms the curved surface 68 of the roller bearing adapter 60. The curved rocker surface 184 of the rocker member 82 is adapted to rockably engage the curved surface 68 of the roller bearing adapter 60 such that the axis 186 is generally parallel to the axis 70. The curved rocker surface 184 of the rocker member 82 and the curved surface 68 of the roller bearing adapter 60 allow transverse rocking movement of the rocker member 82 with respect to the roller bearing adapter 60 in a direction generally transverse to the axes 70 and 186. The rocker member 82 is preferably made from hardened steel.

In operation, the projection 100 of the elastomeric pad 80 is inserted into the cavity 144 of the rocker member 82. If desired, the projection 100 may be attached to the rocker member 82 by adhesive bonding or other means. The pedestal rocker seat 30 is inserted into the pedestal roof cavity 44 such that the upper surface 86 of the elastomeric pad 80 engages the top wall 46 of the pedestal 36. Clearances are provided between the side walls 178 and 182 of the rocker member 82 and the side walls 48 and 50 of the pedestal roof cavity 44. A pair of retention bar members 190 a re respectively inserted into each groove 180 in the longitudinal side walls 178 of the rocker member 82 and are attached to the pedestal 36 to retain the pedestal rocker seat 30 within the pedestal roof cavity 44. The roller bearing adapter and axle assembly 58 is then inserted into the pedestal 36 between the first pedestal jaw 38 and second pedestal jaw 40 such that the curved rocker surface 184 of the rocker member 82 engages the curved surface 68 of the roller bearing adapter 60. The linear axis 186 about which the curved rocker surface 184 is formed, and the linear axis 70 about which the curved surface 68 is formed, are both disposed generally parallel to the longitudinal axis 52 of the side frame 34. The curved rocker surface 184 of the rocker member 82 enables the pedestal rocker seat 30 and the side frame 34 to transversely rock with respect to the roller bearing adapter 60 and the axle 64 in a direction generally parallel to the longitudinal axis 66 of the axle 64. The bottom of the side frame 34 may thereby swing transversely with respect to the longitudinal axis 52 across the railroad track with a pendulum-like motion.

The inclined faces 108, 114, 120 and 126 of the projection 100 of the elastomeric pad 80 absorb sheer forces between the roller bearing adapter 60 and the side frame 34, provide centering forces to the axle 64, and dampen the motion of the axle 64. The elastomeric pad 80 enables the axle 64 to angularly pivot in a generally horizontal plane with respect to the side frame 34 during curving to provide the railway truck 32 with passive axle steering which reduces the angle of attack of the axle wheel to the rail. The side frame height, and the structure and strength of the pedestals 36 as used in currently constructed SWING MOTION trucks may be used in connection with the pedestal rocker seat 30 without modification. The relative sizes of the pedestal roof cavity 44, the elastomeric pad 80 and the rocker member 82 may be modified as desired.

A modified embodiment of the pedestal rocker seat is shown in FIGS. 12–22 and is identified with the reference number 200. The pedestal rocker seat 200 is adapted to be used with a rigid railway truck 202 having side frames 204. The railway truck 202 is constructed substantially identical to the railway truck 32 except the height of the side frame 204 above the pedestal cavity 44 is reduced from the height of the side frame 34. Otherwise, the side frame 204 is constructed substantially similar to the side frame 34. The elements that are similarly contained in the side frame 204 as in the side frame 34 are indicated with like reference numbers in FIG. 12–16.

The pedestal rocker seat 200 is used in connection with a roller bearing adapter and axle assembly 210 including a roller bearing adapter 212, a bearing 214 and an axle 216. The axle 216 includes a central longitudinal axis 218. The bearing 214 provides rotational movement of the axle 216 about the axis 218 with respect to the roller bearing adapter 212. The axis 218 is disposed generally perpendicular to the longitudinal axis 52 of the side frame 204. The roller bearing adapter 212 is preferably an A.A.R. standard adapter having an upper surface 220.

Figure 17:
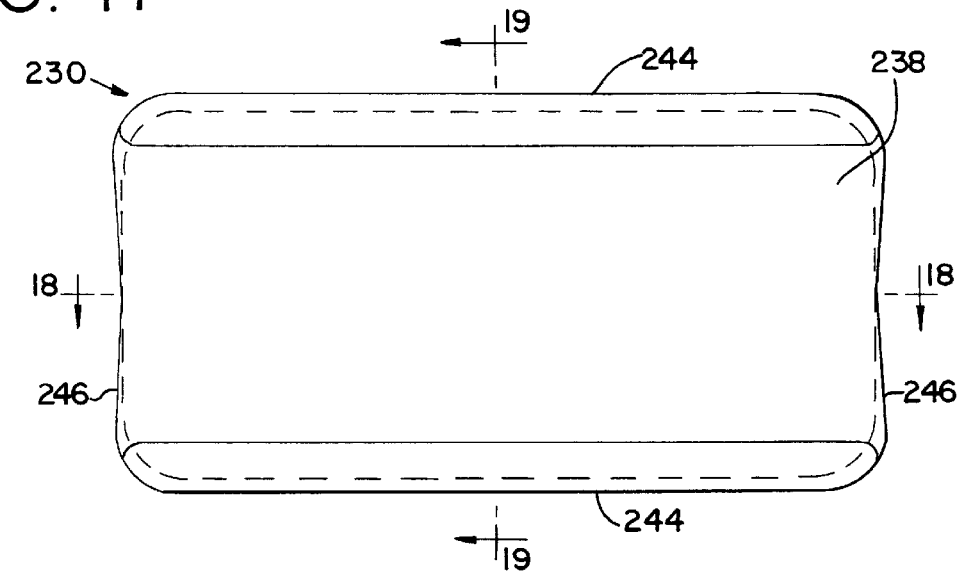
FIG. 17 is a bottom view of the rocker seat bearing of the modified pedestal rocker seat.
Figure 18:
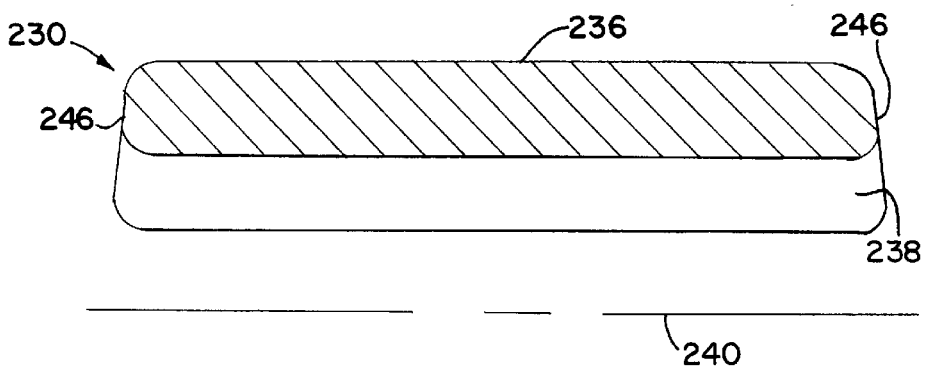
FIG. 18 is a cross-sectional view taken along line 18—18 of FIG. 17.
Figure 19:
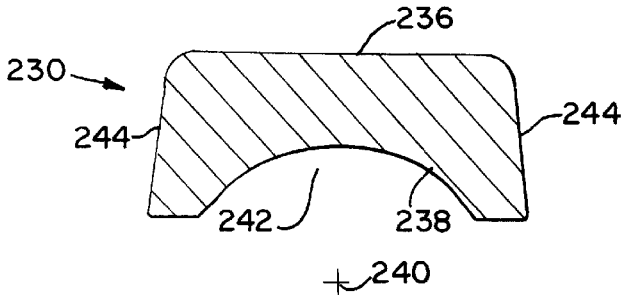
FIG. 19 is a cross-sectional view taken along line 19—19 of FIG. 17.

The pedestal rocker seat 200 includes a rocker seat bearing 230, a rocker member 232 and an elastomeric pad 234. The rocker seat bearing 230, as best shown in FIGS. 17–19, is generally rectangular and includes a generally planar upper surface 236 and an opposing concave generally cylindrical-shaped curved lower surface 238 formed at a first radius from a linear axis 240. The curved lower surface 238 forms a cradle 242. The rocker seat bearing 230 also includes a pair of spaced apart longitudinal side walls 244 and a pair of spaced apart transverse side walls 246 that are generally perpendicular to the longitudinal side walls 244. The rocker bearing seat 230 is adapted to be placed within the pedestal roof cavity 44 of the pedestal 36 such that the upper surface 236 engages the top wall 46 of the pedestal roof cavity 44. The rocker seat bearing 230 is sized such that side walls 244 and 246 fit closely within the side walls 48 and 50 of the pedestal roof cavity 442 The rocker seat bearing 230 is held within the pedestal roof cavity 44 by a pair of spaced apart retention bar members 190 that are attached to the pedestal 36. The rocker seat bearing 230 is preferably formed from hardened steel.

Figure 20:
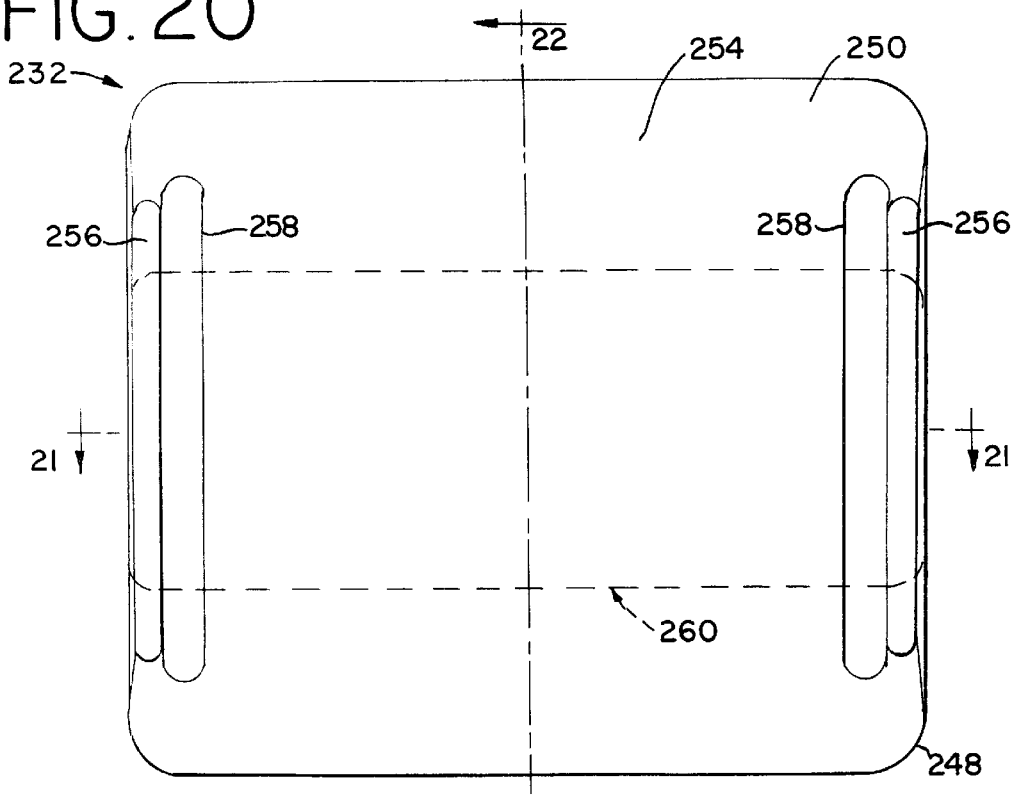
FIG. 20 is a bottom view of the rocker member of the modified pedestal rocker seat.
Figure 21:
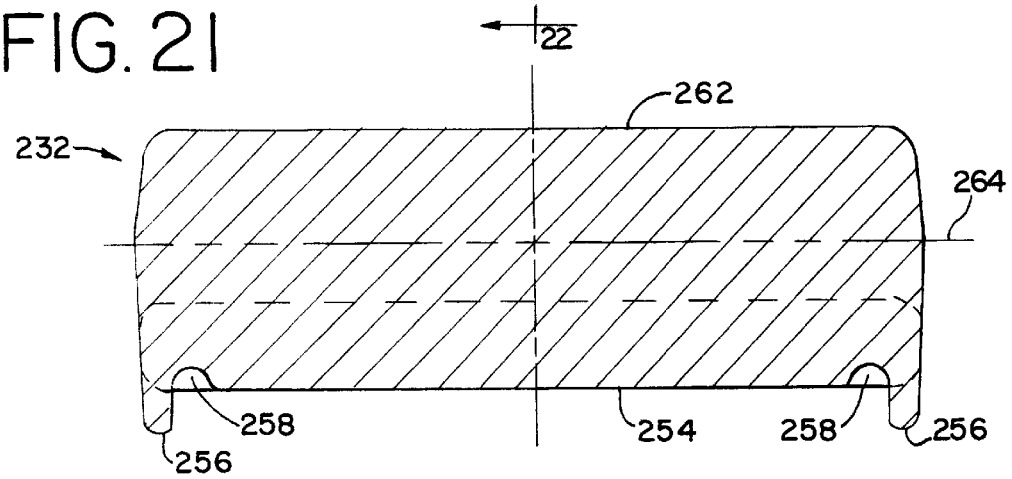
FIG. 21 is a cross-sectional view taken along line 21—21 of FIG. 20.
Figure 22:
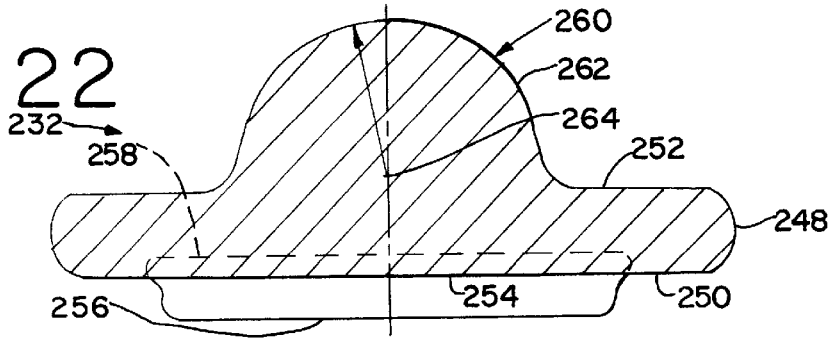
FIG. 22 is a cross-sectional view taken along line 22—22 of FIG. 20.

The rocker member 232 as best shown in FIGS. 20–21 includes a base member 248 having a first side 250 and a second side 252. The first side 250 includes a generally planar lower surface 254. The first side 250 also includes a pair of downwardly extending elongate lugs 256. The lugs 256 are located at opposite ends of the base member 248 and are generally parallel to one another. The base member 248 also includes a pair of elongate grooves 258 formed in the lower surface 254 that are spaced apart and generally parallel to one another. Each groove 258 is respectively located adjacent to and interiorly of a lug 256.

An elongated generally semi-cylindrical projection 260 extends outwardly from the second side 252 of the base member 248. The projection 260 includes a convex generally cylindrical-shaped curved surface 262 formed at a second radius about a second generally linear axis 264. The length of the radius struck from the second linear axis 264 that forms the curved surface 262 is shorter than the first radius that forms the curved lower surface 238 of the rocker seat bearing 230. The projection 260 is adapted to be placed within the cradle 242 of the rocker seat bearing 230 such that the curved surface 262 rockably engages the curved lower surface 238, and such that the linear axis 264 is generally parallel to the linear axis 240 and to the longitudinal axis 52 of the side frame 204. The engagement of the curved surface 262 with the curved lower surface 238 of the rocker seat bearing 230 enables transverse rocking movement of the rocker seat bearing 230 and side frame 204 in a direction generally parallel to the longitudinal axis 218 of the axle 216. The rocker member 232 is preferably made of hardened steel.

Figure 13:
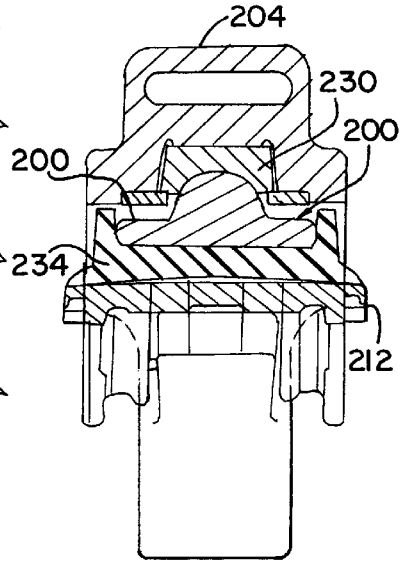
FIG. 13 is a transverse cross-sectional view of the modified pedestal rocker seat shown in its installed position.
Figure 14:
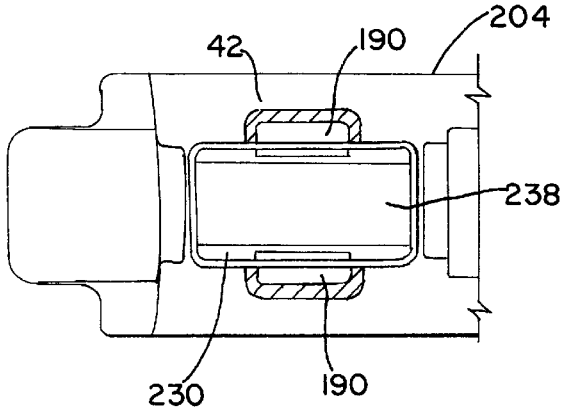
FIG. 14 is a bottom view of the rocker seat bearing of the pedestal rocker seat shown in its installed position.
Figure 15:
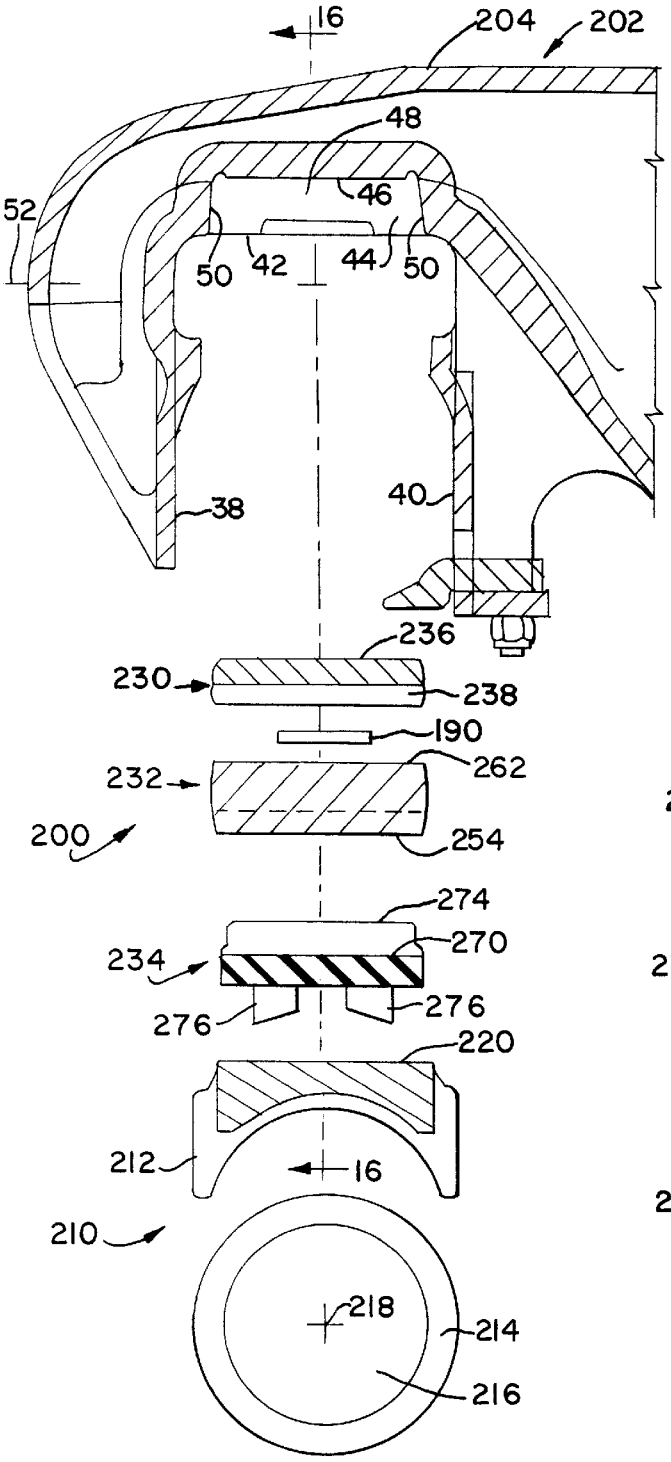
FIG. 15 is a longitudinal cross-sectional exploded view of the modified embodiment of the pedestal rocker seat, side frame, roller bearing adapter and axle assembly.
Figure 16:
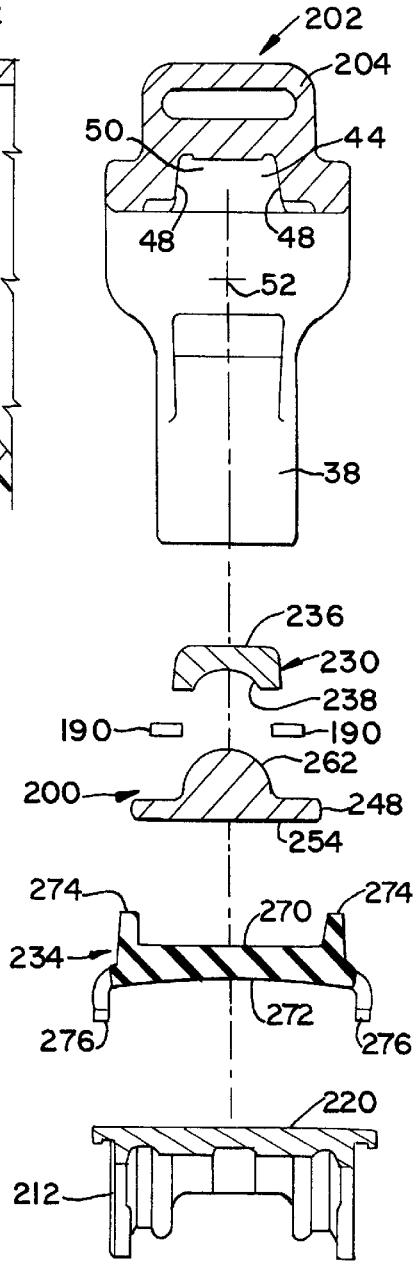
FIG. 16 is a transverse cross-sectional exploded view taken along line 16—16 of FIG. 15.

The elastomeric pad 234, as shown in FIGS. 15 and 16, includes a generally planar upper surface 270 and an opposing generally parallel lower surface 272. A pair of spaced apart and generally parallel elongate lugs 274 extend upwardly from the upper surface 270. The lugs 274 are located on opposite sides of the elastomeric pad 234. A pair of spaced apart ears 276 extend downwardly below the lower surface 272 on the same opposing sides of the elastomeric pad 234 on which the lugs 274 are located. As best shown in FIG. 13, the base member 248 of the rocker member 232 is adapted to be inserted between the lugs 274 of the elastomeric pad 234 such that the lower surface 254 of the rocker member 232 engages the upper surface 270 of the elastomeric pad 234. The roller bearing adapter 212 is similarly adapted to fit between the opposing set of ears 276 such that the upper surface 220 engages the lower surface 272 of the elastomeric pad 234. The elastomeric pad 234 thereby interlocks the rocker member 232 with the roller bearing adapter 212. The elastomeric pad 234 is preferably made from an elastomeric material such as a natural and synthetic rubber compound having a sheer stiffness of 22,000 to 35,000 pounds per inch. A preferred elastomeric pad 234 is the LC pad assembly as manufactured by Lord Corporation.

In operation, the engagement between the curved surface 262 of the rocker member 232 and the curved lower surface 238 of the rocker seat bearing 230 enables the rocker seat bearing 230 and side frame 204 to transversely rock with respect to the roller bearing adapter 212 and the axle 216 in a direction generally parallel to the longitudinal axis 218 of the axle 216. The elastomeric pad 234 of the pedestal rocker seat 200 enables angular horizontal pivotal movement of the axle 216 with respect to the rocker seat bearing 230, rocker member 232 and side frame 204. The railway truck 202 utilizing pedestal rocker seats 200 is thereby provided with passive axle steering to improve curving performance and enables transverse rocking or lateral motion of the side frame to control hunting.

Various features ofthe invention have been particularly shown and described in connection with the illustrated embodiments of the invention, however, it must be understood that these particular arrangements merely illustrate, and that the invention is to be given its fullest interpretation within the terms of the appended claims.

What is claimed is:

1. A pedestal rocker seat adapted for use in connection with a railway truck including a side frame having a longitudinal axis and a pedestal having spaced apart first and second pedestal jaws and a pedestal roof including a pedestal roof cavity, and a roller bearing adapter member located between the first and second pedestal jaws coupled to a rotatable axle having a longitudinal axis disposed generally transverse to the longitudinal axis of the side frame, said pedestal rocker seat including:

an elastomeric pad adapted to be placed within the pedestal roof cavity of the pedestal of the side frame, said pad including a base member having an upper surface adapted to be placed in engagement with the pedestal of the side frame, and a generally pyramidal-shaped projection extending outwardly from said base member, said projection having a generally pyramidal-shaped lower surface, said upper surface and said lower surface of said pad being disposed on opposite sides of said pad relative to one another; and a rocker member having a top side and an opposing bottom side, said top side including a generally pyramidal-shaped surface forming a generally pyramidal-shaped cavity, said pyramidal-shaped projection of said elastomeric pad adapted to be disposed within said pyramidal-shaped cavity of said rocker member, said pyramidal-shaped cavity being complementarily shaped with respect to said pyramidal-shaped projection such that said pyramidal-shaped surface of said projection of said elastomeric pad matingly engages said pyramidal-shaped surface of said cavity of said rocker member, said bottom side of said rocker member including a convex generally cylindrical-shaped curved rocker surface, said rocker surface being curved about a generally linear axis, said rocker surface adapted to rockably engage the roller bearing adapter member with said linear axis of said rocker member disposed generally parallel to the longitudinal axis of the side frame;

whereby said pedestal rocker seat enables the side frame to rock transversely with respect to the axle, and enables the axle to horizontally pivot with respect to the side frame to provide the railway truck with passive axle steering.

2. The pedestal rocker seat of claim 1 wherein said pyramidal-shaped projection of said elastomeric pad includes a first face, a second face, a third face, and a fourth face, each said face extending from a base of said projection toward an apex of said projection.

3. The pedestal rocker seat of claim 2 wherein said base of said pyramidal-shaped projection is generally rectangular.

4. The pedestal rocker seat of claim 3 wherein said rectangular base of said projection of said elastomeric pad includes a first generally linear edge and an opposing generally parallel second generally linear edge, and a third generally linear edge and an opposing generally parallel fourth generally linear edge, said first and second edges being generally perpendicular to said third and fourth edges, said first and second edges each having a length that is longer than the length of said third and fourth edges.

5. The pedestal rocker seat of claim 4 wherein said first and second edges of said base of said projection are adapted to extend generally parallel to said linear axis about which said curved surface of said rocker member is formed.

6. The pedestal rocker seat of claim 1 wherein said pyramidal-shaped projection comprises a pyramidal frustum including an apex having an apex surface.

7. The pedestal rocker seat of claim 6 wherein said pyramidal-frustum includes a first face, a second face, a third face, and a fourth face, wherein each said face includes a truncated generally triangular surface extending from a base of said projection to said apex surface.

8. The pedestal rocker seat of claim 7 wherein said pyramidal-shaped cavity of said rocker member includes a first face, a second face, a third face, and a fourth face, wherein each said face of said cavity is generally triangular-shaped, each said first through fourth face of said cavity adapted to matingly engage a respective one of said first through fourth faces of said projection of said elastomeric pad.

9. The pedestal rocker seat of claim 8 wherein each said face of said pyramidal-frustum of said elastomeric pad and each said face of said cavity of said rocker member is generally planar.

10. The pedestal rocker seat of claim 1 wherein said rocker member includes opposing longitudinal side walls wherein each said longitudinal side wall includes a groove.

11. The pedestal rocker seat of claim 10 including a pair of retention members, each said retention member adapted to be attached to the pedestal of the side frame and to extend into a respective groove in said rocker member to retain said rocker member to the pedestal.

12. A pedestal rocker seat adapted for use in connection with a railway truck including a side frame having a longitudinal axis and a pedestal having spaced apart first and second pedestal jaws and a pedestal roof including a pedestal roof cavity, and a roller bearing adapter member located between the first and second pedestal jaws coupled to a rotatable axle having a longitudinal axis disposed generally transverse to the longitudinal axis of the side frame, said pedestal rocker seat including:

a rocker seat bearing having an upper surface and an opposing concave generally cylindrical-shaped curved lower surface formed at a first radius about a first generally linear axis, said lower surface forming a cradle, said rocker seat bearing adapted to be placed within the pedestal roof cavity of the pedestal of the side frame such that said upper surface of said rocker seat bearing engages the pedestal of the side frame;

a rocker member including a base member having a first side and an opposing second side, and a generally semi-cylindrical projection extending outwardly from said second side of said base member, said projection including a convex generally cylindrical-shaped curved surface formed at a second radius about a second generally linear axis, said projection adapted to be placed in said cradle of said rocker seat bearing such that said convexly curved surface of said rocker member rockably engages said concavely curved surface of said rocker seat bearing such that said rocker seat bearing and said rocker member are rockable with respect to one another generally transversely to said first linear axis of said rocker seat bearing and said second linear axis of said rocker member, said first side of said base member including a lower surface; and an elastomeric pad having an upper surface and an opposing bottom surface, said upper surface adapted to engage said lower surface of said base member of said rocker member, said bottom surface of said elastomeric pad adapted to engage the roller bearing adapter member;

whereby said pedestal rocker seat enables the side frame to transversely rock with respect to the axle and enables the axle to horizontally pivot with respect to the side frame to provide the railway truck with passive axle steering.

13. The pedestal rocker seat of claim 12 wherein said first radius of said concavely curved surface of said rocker seat bearing is longer than said second radius of said convexly curved surface of said rocker member.

14. The pedestal rocker seat of claim 12 wherein said rocker member includes first and second elongate lugs extending downwardly from said first side of said base member, said lugs being located generally parallel to one another respectively at opposite ends of said base member and generally perpendicular to said second linear axis such that the elastomeric pad may be disposed between said lugs and longitudinally interlocked with said rocker member by said lugs.

15. The pedestal rocker seat of claim 14 wherein said rocker member includes a first groove and a second groove formed in said first side of said base member, said first and second grooves being spaced apart and generally parallel to one another and extending generally transversely to said second linear axis.

16. The pedestal rocker seat of claim 15 wherein each said groove is located adjacent and interiorly to a respective lug.

17. The pedestal rocker seat of claim 12 including a pair of retention members adapted to be attached to the pedestal of the side frame on opposite sides of said rocker seat bearing to retain said rocker seat bearing in the pedestal roof cavity.

* * * * *